United States Patent [19]

Hagler

[11] Patent Number: 4,825,517

[45] Date of Patent: May 2, 1989

[54] APPARATUS FOR DRAWING AND INTERLACING

[75] Inventor: Gerald E. Hagler, Simpsonville, S.C.

[73] Assignee: Phillips Petroleum Company, Bartlesville, Okla.

[21] Appl. No.: 671,649

[22] Filed: Nov. 15, 1984

[51] Int. Cl.[4] ..... D02J 1/08; D02J 1/22

[52] U.S. Cl. ..... 28/220; 28/245

[58] Field of Search ..... 28/245, 246, 220

[56] References Cited

U.S. PATENT DOCUMENTS

| | | | |
|---|---|---|---|
| 2,692,875 | 10/1954 | Weinstock, Jr. et al. | 28/246 X |
| 2,962,793 | 12/1960 | Powers et al. . | |
| 3,069,745 | 12/1962 | Schippers | 28/245 |
| 3,114,999 | 12/1963 | Coggeshall . | |
| 3,400,194 | 9/1968 | Boone et al. | 28/245 X |
| 3,766,614 | 10/1973 | Coats et al. | 28/246 X |
| 3,801,242 | 4/1974 | Bauch . | |
| 3,890,422 | 6/1975 | Livingston . | |

FOREIGN PATENT DOCUMENTS

| | | | |
|---|---|---|---|
| 2006791 | 1/1970 | France | 28/245 |
| 462766 | 1/1971 | Japan | 28/245 |

*Primary Examiner*—Robert R. Mackey

*Attorney, Agent, or Firm*—Williams, Phillips & Umphlett

[57] ABSTRACT

Spin-drawing apparatus for simultaneously drawing and optionally entangling one or more yarn ends. The apparatus comprises three pairs of heated cylindrical rolls which provide for two stages of yarn drafting, the first two pairs of rolls being inclined at an acute angle to a vertical plane and being generally mutually parallel, and the third pair of rolls being generally perpendicular to the vertical plane. The yarn ends are (a) initially directed to the inner ends of the first pair of rolls, (b) directed from the outer ends of the first pair of rolls to the inner ends of the second pair of rolls, (c) directed from the outer ends of the second pair of rolls to the inner ends of the third pair of rolls, (d) directed from the outer ends of the third pair of rolls through optional corresponding yarn entanglers, and (e) directed from the optional yarn entanglers to corresponding yarn packages. The arrangement of the three pairs of rolls and the associated winding apparatus results in an extremely compact configuration adapted for use in restricted existing work spaces.

26 Claims, 2 Drawing Sheets

APPARATUS FOR DRAWING AND INTERLACING

Figure 1:
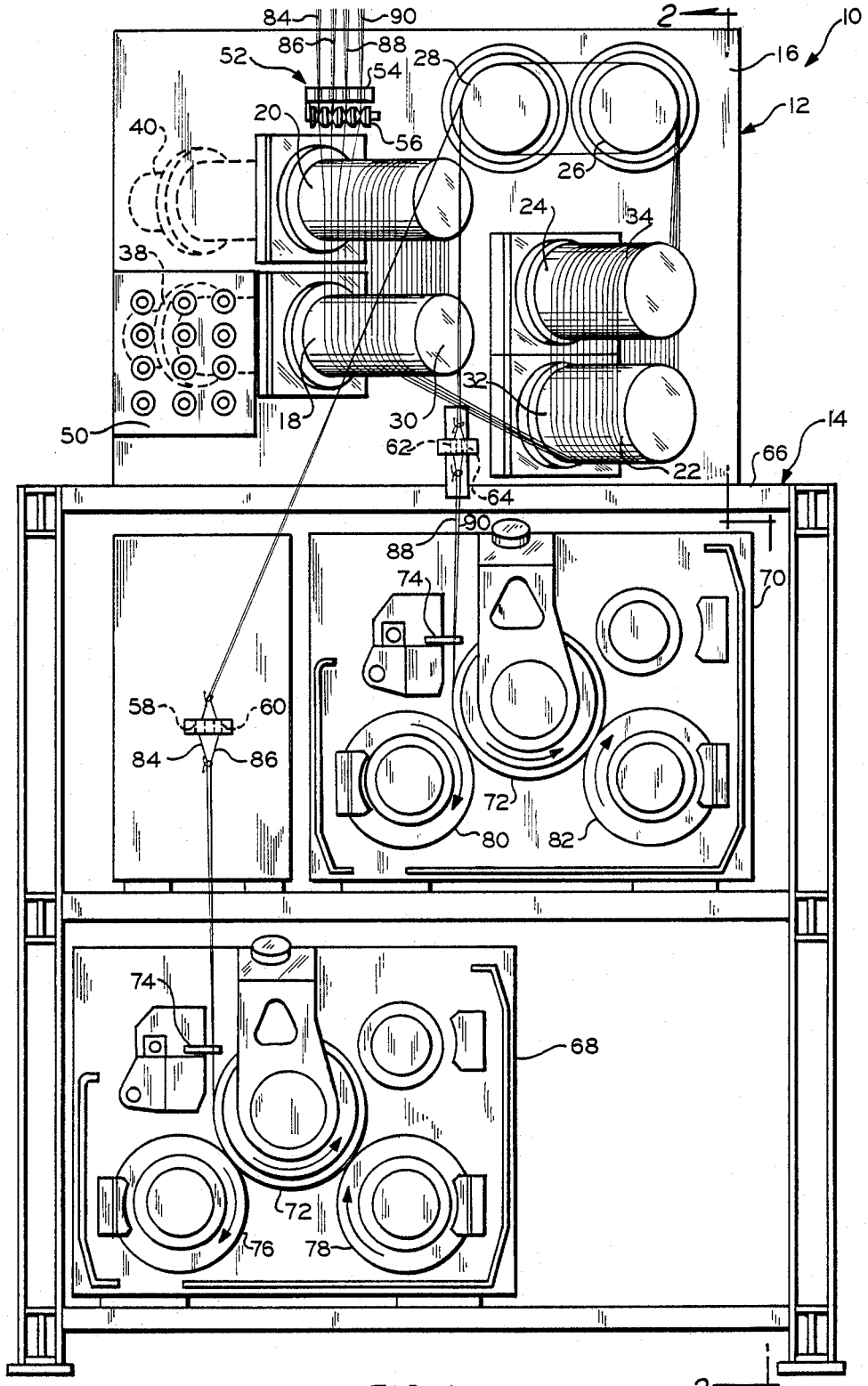

The invention relates generally to drawing synthetic yarn. In one aspect, the invention relates to a method of simultaneously spin-drawing a plurality of synthetic multifilament yarns. In another aspect, the invention relates generally to apparatus for simultaneously drawing a plurality of synthetic multifilament yarns.

In the past, spin-draw machines have been built in configurations such as those illustrated in U.S. Pat. Nos. 2,962,793; 3,801,242; and 3,890,422. The present invention provides improvements in apparatus size, configuration and construction over prior spin-draw systems, as well as improvements in operating characteristics over the operating characteristics of prior spin-draw systems.

The present invention contemplates novel apparatus useable for spin-drawing yarns. The apparatus includes a generally vertical support plate which defines a generally vertical support plane. First and second rolls are rotatably mounted on the support plate. The first and second rolls have corresponding first and second axes of rotation lying in corresponding first and second generally horizontal planes vertically spaced one from the other. The first and second axes of rotation define corresponding first and second acute angles with the generally vertical support plane with the first and second acute angles being substantially equal. Third and fourth rolls are also rotatably mounted on the support plate with the corresponding third and fourth axes of rotation thereof lying in corresponding third and fourth generally horizontal planes vertically spaced one from the other and defining corresponding third and fourth acute angles with the generally vertical support plane. The third and fourth acute angles are substantially equal to each other and are substantially equal to the first and second acute angles. The first and third rolls are positioned relative to each other such that a line mutually perpendicular to the first and third axes of rotation and intersecting the first axis of rotation adjacent the other end thereof remote from the support plate intersects the third axis of rotation adjacent the inner end thereof proximate the support plate.

In one embodiment of the apparatus, fifth and sixth rolls are rotatably mounted on the support plate with the corresonding fifth and sixth axes of rotation thereof lying in corresponding generally vertical planes horizontally spaced one from the other. The fifth axis of rotation is substantially perpendicular to the generally vertical support plane, and the sixth axis of rotation intersects the generally vertical support plane at an angle slightly less than 90°. The fourth and fifth rolls are positioned relative to each other such that a line tangent to the cylindrical outer surface of the fourth roll adjacent the outer end thereof remote from the support plate is mutually tangent to the cylindrical outer surface of the fifth roll adjacent the inner end thereof proximate the support plate.

A further embodiment of the invention is characterized by first yarn winder means operatively related to the fifth roll for rotating a yarn takeup device located in mutual tangential aligment with the outer end portion of the fifth roll and/or second yarn winder means operatively related to the sixth roll for rotating a yarn takeup device located in mutual tangential alignment with the outer end portion of the sixth roll.

An additional feature or aspect of the invention resides in the optional provision of yarn entangler means intermediate the fifth and/or sixth rolls and the corresponding yarn takeup devices for entangling or interlacing yarn ends directed therethrough.

An object of the invention is to increase the efficiency of spin-drawing one or more synthetic yarns.

Another object of the invention is to provide yarn spin-drawing apparatus having extremely compact dimensions. Still another object of the invention is to simplify the performance of synthetic yarn spin-drawing operations.

Yet another object of the invention is to provide improved yarn spin-drawing apparatus capable of simultaneously spin-drawing a plurality of synthetic multifilament yarn ends and configured to be installed in existing yarn spinning production lines without the relocation of existing filament extruders and spinnerets.

Figure 2:
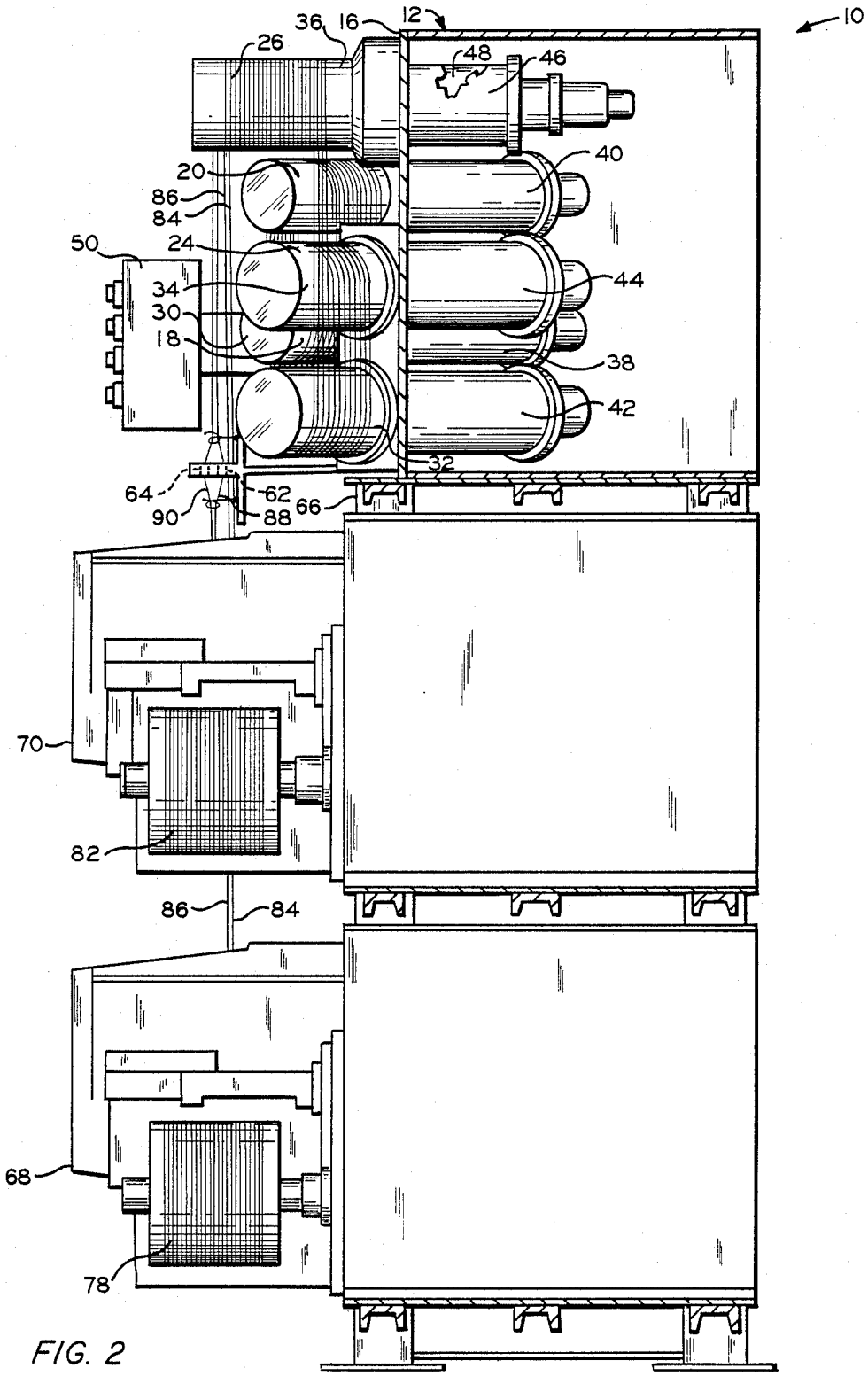

Other objects, aspects and advantages of the instant invention will become even more apparent from the following detailed description of the invention when read in conjunction with the accompanying drawings in which:

FIG. 1 is a front elevational view of spin-drawing apparatus constructed in accordance with the invention; and FIG. 2 is a vertical cross-sectional view taken along line 2—2 of FIG. 1.

Referring now to the drawings, a system useable for simultaneously spin-drawing a plurality of synthetic continuous filament yarns is generally designated by the reference character 10. The system 10 comprises a drawing assembly 12 and a yarn takeup assembly 14.

The drawing assembly 12 comprises a generally vertical support plate 16. The support plate 16 defines a generally vertical support plane which will be used as a reference plane for the positioning of other elements of the drawing assembly 12. First and second rolls 18 and 20 are rotatably mounted on the support plate 16. The rolls 18 and 20 are both motor-driven rolls which are rotated about corresponding first and second axes of rotation at rotational speeds producing the same first peripheral speed at the outer surfaces of the first and second rolls. The outer surfaces of the first and second rolls are preferably cylindrical in shape. The first and second rolls function together as a feed roll assembly.

The drawing assembly 12 additionally includes third and fourth rolls 22 and 24 which are also rotatably mounted on the support plate 16. The rolls 22 and 24 are both motor-driven rolls which are rotated about corresponding third and fourth axes of rotation at rotational speeds producing the same second peripheral speed at the outer surfaces of the third and fourth rolls. The outer surfaces of the third and fourth rolls are also preferably cylindrical in shape. The third and fourth rolls function together as a draw roll assembly. The second peripheral speed associated with the draw roll assembly is greater than the first peripheral speed associated with the feed roll assembly when drawing yarn between these assemblies.

The drawings assembly 12 is further provided with a let back roll assembly comprising fifth and sixth rolls 26 and 28 which are rotatably mounted on the support plate 16. The rolls 26 and 28 are both motor-driven rolls which are rotated about corresponding fifth and sixth axes of rotation at rotational speeds producing the same third peripheral speed at the outer surfaces of the fifth and sixth rolls. The outer surfaces of the fifth and sixth rolls are also preferably cylindrical in shape. The third peripheral speed associated with the let back roll assembly is less than the secured peripheral speed associated with the draw roll assembly when letting back or reducing the tension on the yarn between these assemblies. It will be understood, however, that, if so desired, the assembly comprising rolls 26 and 28 can be employed as a second stage draw roll assembly wherein the third peripheral speed associated therewith is greater than the second peripheral speed associated with the first stage draw roll assembly comprising rolls 22 and 24.

A significant aspect of the present invention resides in the positioning and alignment of the axes of rotation of the rolls 18, 20, 22, 24, 26 and 28 with respect to the generally vertical support plane defined by the support plate 16. The first and second axes of rotation of the first and second rolls 18 and 20 lie respectively in corresponding first and second generally horizontal planes which are vertically spaced one from the other, with the first and second axes of rotation defining first and second acute angles with the generally vertical support plane. The first and second acute angles are preferably substantially equal although the first acute angles can be slightly greater than the second acute angle so as to allow the second roll 20 to function as a separator roll relative to the first roll 18. It is presently preferred that the second generally horizontal plane is inclined slightly downwardly from the vertical support plane at an angle of up to about 13°, preferably about 8°, from the horizontal to permit the second roll 20 to function as a separator roll relative to the first roll 18. In a similar manner, the axes of rotation of third and fourth rolls 22 and 24 lie respectively in corresponding third and fourth generally horizontal planes which are vertically spaced one from the other, with the third and fourth axes of rotation defining third and fourth acute angles with the generally vertical support plane. The third and fourth acute angles are also preferably substantially equal although the third acute angle can be slightly greater than the fourth acute angle so as to allow the fourth roll 24 to function as a separator roll relative to the third roll 22. It is presently preferred that the fourth generally horizontal plane is inclined slightly downwardly from the vertical support plane at an angle of up to about 13°, preferably about 8°, from the horizontal to permit the fourth roll 24 to function as a separator roll relative to the third roll 22.

The first and third rolls 18 and 22 are positioned relative to each other on the support plate 16 such that a line mutually perpendicular to the axes of rotation of the rolls 18 and 22 and intersecting the first axis of rotation of the first roll 18 adjacent the outer end 30 thereof remote from the support plate 16 intersects the third axis of rotation of the third roll 22 adjacent the inner end 32 thereof proximate the support plate 16.

The fifth and sixth axes of rotation of the fifth and sixth rolls 26 and 28 lie respectively in corresponding generally vertical planes horizontally spaced one from the other, with the fifth axis of rotation being aligned substantially perpendicular to the generally vertical support plane and with the sixth axis of rotation intersecting the generally vertical support plane at an angle slightly less than 90°. It is presently preferred that the sixth axis of rotation is inclined upwardly from the vertical support plate at an angle of up to about 13°, preferably about 5°, from the horizontal to permit the sixth roll 28 to function as a separator roll relative to the fifth roll 26.

In an alternate embodiment, the fifth axis of rotation of the fifth roll 26 lies in a generally vertical plane and the sixth axis of rotation of the sixth roll 28 lies in the generally horizontal plane with the fifth and sixth axis of rotation being spaced horizontally one from the other. In this embodiment, the fifth axis of rotation is aligned substantially perpendicular to the generally vertical support plane and the sixth axis of rotation intersects the generally vertical support plane at an angle slightly less than 90°.

In either of the above-described embodiments, the inner ends of the fourth and fifth rolls 24 and 26 are positioned relative to each other such that a line tangent to the cylindrical outer surface of the fourth roll 24 adjacent the outer end 34 thereof remote from the support plate 16 is mutually tangent to the cylindrical outer surface of the fifth roll 26 adjacent the inner end 36 thereof proximate the support plate 16. The inner ends of the fifth and sixth rolls 26 and 28 lie generally in a common plane parallel to the generally vertical support plane defined by the support plate 16, and the inner ends of the first, second, third and fourth rolls 18, 20, 22 and 24 lie generally in a common plane mutually parallel to and between the generally vertical support plane and the plane in which the inner ends of the fifth and sixth rolls 26 and 28 lie.

In order to provide the desired separation of yarns passing around the first pair of rolls 18 and 20 of the feed roll assembly, it is presently preferred that the distance between the axes of rotation of the first and second rolls at the outer ends thereof is slightly less than the distance between the axes of rotation at the inner ends thereof. This same distance relationship holds true for the second pair of rolls 22 and 24 of the draw roll assembly. For the third pair of rolls 26 and 28 of the let back roll assembly, the distance between the respective axes of rotation at the outer ends thereof is greater than the distance between the axes at the inner end thereof.

The rolls 18, 20, 22, 24, 26 and 28 are preferably driven by individual corresponding electric drive motors 38, 40, 42, 44, 46 and 48 which are conventional in the art of yarn processing. It will be understood that, if desired, the first pair of rolls 18 and 20 can be mechanically coupled and be driven by a corresponding single motor, as can each of the other pairs of rolls, 22 and 24, and 26 and 28. It will also be readily apparent that all six rolls can be mechanically mutually coupled and be driven by a single motor or other suitable drive means. In the preferred embodiment, the rotational speeds of the rolls driven by corresponding individual drive motors can be conveniently adjusted, even during operation, by suitable electrical control means housed in control box 50 which can be conveniently mounted on the support plate 16. It is presently preferred to employ permanent magnet synchronous, three phase, AC electric motors whose rotational speed can be readily controlled by appropriate inverters associated therewith.

While rolls of any suitable size can be employed in the present invention, it is presently preferred to use rolls having a cylindrical outer surface length of about 12.4 in. (31.5 cm.). The cylindrical outer surfaces of rolls 18 and 20 preferably have diameters of about 5 in. (12.7 cm.) and the cylindrical outer surfaces of rolls 22, 24, 26 and 28 preferably have diameters of about 6.25 in. (15.9 cm.).

The acute angles between the axes of rotation of the rolls 18, 20, 22 and 24 and the generally vertical support plane preferably fall generally in the range from about 35° to about 63° and, more preferably from about 40° to about 50°, with a nominal angle of 45° being preferred.

Each of the rolls 18, 20, 22, 24, 26 and 28 is preferably provided with suitable means for adjusting the vertical and/or horizontal angle between the rotational axis thereof and the vertical support plane through a range of about ±5° from the nominal angles between these axes of rotation and the vertical support plane.

In operation, the first and second rolls 18 and 20 are suitably driven, as described above, at the same first peripheral speed at their cylindrical outer surfaces, and the third and fourth rolls 22 and 24 are suitably driven at the same second peripheral speed at their cylindrical outer surfaces, with the second peripheral speed being greater than the first peripheral speed. The second peripheral speed is generally in the range from about 2 to about 4.5 times the first peripheral speed, thus providing a preferred range of draw ratios of from about 2 to about 4.5 between the feed roll assembly and the draw roll assembly. The fifth and sixth rolls 26 and 28 are suitably driven, as described above, at the same third peripheral speed at their cylindrical outer surfaces, and this third peripheral speed is less than the second peripheral speed when the fifth and sixth rolls 26 and 28 function as a let back roll assembly. The third peripheral speed is generally from about 0.92 to about 0.99 times the second peripheral speed and is preferably from about 0.95 to about 0.97 times the second peripheral speed, thus providing a desirable degree of overfeed or let back of drawn yarn between the draw rolls 22 and 24 and the let back rolls 26 and 28 to relax the tension on the drawn yarn.

Each of the rolls 18, 20, 22, 24, 26 and 28 is provided with conventional electrical induction heating means to maintain the cylindrical outer surfaces at the desired temperature. Each roll is provided with a temperature sensor which provides a signal representative of the sensed temperature of the respective cylindrical outer surface back to a suitable temperature controller which utilizes the thus received signal to regulate the temperature within a predetermined range. It is presently preferred that the temperature controller be capable of controlling the roll surface temperature within the range from about 50° C. to about 300° C. In the handling of polyolefin yarns on the apparatus of the present invention, it is presently preferred to maintain the surfaces of feed rolls 18 and 20 at a temperature of about 110° C., and to maintain the surfaces of draw rolls 22 and 24 as well as let back rolls 26 and 28 at a temperature of about 175° C.

The presently preferred polyolefin yarn for use on the apparatus of the present invention comprises continuous filaments of polypropylene.

The drawing assembly 12 further includes a metered finish and applicator assembly 52 mounted on the support plate 16 which includes a finish applicator subassembly 54 and a yarn guide spacer 56 journaled therebelow. The assembly 52 is capable of applying finish to one or more synthetic, continuous filament yarn ends, e.g., four yarn ends, which are passed thereover directly from the filament producing spinnerets (not shown) on their way to the rolls 18 and 20 of the feed roll assembly. The illustrated spin-drawing system 10 is capable of simultaneously spin-drawing and separately packaging up to four synthetic continuous filament yarn ends, the finish applicator subassembly 54 is connected by suitable conduit means to a metered source of liquid finish, not shown.

The drawing assembly 12 further includes four separate jet entanglers 58, 60, 62 and 64 for simultaneously entangling or interlacing up to four synthetic continuous filaments yarn ends after spin-drawing. The jet entangers 62 and 64 are conveniently mounted on the support plate 16 with the entanglers 62 and 64 located below roll 28. The jet entanglers 58 and 60 are conveniently mounted on the frame 66 of the yarn takeup assembly 14.

The yarn takeup assembly 14 comprises the frame 66 upon which the previously described vertical support plate 16 is conveniently supported. First and second yarn winders 68 and 70 are mounted on the frame 66 respectively below rolls 28 and 26. The yarn winders 68 and 70 can be any suitable winders each capable of simultaneously winding at least two yarn ends. One such suitable winder is the IWKA Model EFAS 400. Such winders are capable of producing 10 lb. yarn packages. The winders 68 and 70 are identical and each is provided with a package drive roll 72 and a yarn level wind mechanism 74. Winder 68 is shown with first and second yarn packages 76 and 78, while winder 70 is shown with third and fourth yarn packages 80 and 82. Yarn winder 68 is preferably positioned with its respective level wind mechanism 74 generally below the entanglers 58 and 60. Yarn winder 70 is preferably positioned with its respective level wind mechanism 74 generally below the entanglers 62 and 64.

The operation of the spin-drawing system 10 will be described in terms of the system handling four continuous filament synthetic yarn ends 84, 86, 88 and 90 received by the system from multifilament spinnerets (not shown). The four yarn ends are directed over the finish applicator subassembly 54 and yarn guide spacer 56 where the yarn ends are maintained in a predetermined laterally spaced relationship one to the other. The four yarn ends are then wrapped a suitable number of times, generally from five to eleven times, preferably six to seven times, around feed rolls 18 and 20 from the inner ends thereof to the outer ends thereof while maintaining the lateral spaced relationship among the yarn ends. From the outer end of roll 18, the laterally spaced yarn ends are then passed under roll 22 and are wrapped a suitable number of times, generally from five to eleven times, preferably from six to seven times, around draw rolls 22 and 24 working from the inner ends thereof outwardly while maintaining the previously described lateral spacing. From the outer ends of rolls 22 and 24, the laterally spaced yarn ends are wrapped counterclockwise a suitable number of times, generally from five to eleven times, preferably from six to seven times, around let back rolls 26 and 28 working from the inner ends thereof outwardly while continuing to maintain the lateral spacing among the yarn ends.

From the outer end of let back roll 28, yarn ends 84, 86, 88 and 90 are passed downwardly through corresponding jet entanglers 58, 60, 62 and 64. Yarn ends 84 and 86 are passed downwardly from jet entanglers 58 and 60, respectively, through the level wind mechanism 74 of the winder 68 onto first and second yarn packages 76 and 78, respectively. Similarly, yarn ends 88 and 90 are passed downwardly from jet entanglers 62 and 64, respectively, and through the level wind mechanism 74 of the yarn winder 70 onto third and fourth yarn packages 80 and 82, respectively. The level wind mechanism 74 of the winder 68 simultaneously engages yarn ends 84 and 86 and traverses these yarn ends along corresponding yarn packages 76 and 78, which yarn packages are simultaneously rotated by friction engagement with the package drive roll 72. The operation of the winder 70 with respect to yarn ends 88 and 90 and corresponding yarn packages 80 and 82 is identical to that described above for winder 68.

In an alternate form of the present invention, yarn ends 84 and 86 can be passed downwardly from the outer end of let back roll 28 and yarn ends 88 and 90 can be passed downwardly from the outer end of let back roll 26. The yarn ends 84, 86, 88 and 90 are then respectively directed through jet entanglers 58, 60, 62 and 64. From entanglers 58 and 60, yarn ends 84 and 86 are passed through level wind mechanism 74 of the winder 68 onto first and second yarn packages 76 and 78, respectively. Similarly, yarn ends 88 and 90 are passed from entanglers 62 and 64 and through level wind mechanism 74 of the winder 70 onto third and fourth yarn packages 80 and 82, respectively. It will be understood that all four yarn ends can be similarly directed from let back roll 26 through the jet entangler 58, 60, 62 and 64 onto yarn packages 76, 78, 80 and 82 via yarn winders 68 and 70. In the first mentioned alternate forms of the invention it may be advantageous to locate the jet entanglers 62 and 64 and the level wind mechanism 74 of the winder 70 directly below the let back roll 26, and to locate the jet entanglers 58 and 60 and the level wind mechanism 74 of the winder 68 directly below let back roll 28.

The compact configuration or arrangement of the rolls 18, 20, 22, 24, 26 and 28 on the vertical support plate 16 facilitates the positioning of the drawing assembly 12 below the four multifilament spinnerets (not shown) and above the yarn winders 68 and 70. The configuration of the drawing assembly 12, as well as the spin-drawing system 10 of which it is an integral part, permits the installation of these mechanisms in existing yarn manufacturing lines to produce multiple spin-drawn flat yarns without the necessity of relocating existing extruders and spinnerets as would be necessary with prior spin-draw mechanisms employed in the art.

Another significant advantage of the compact roll configuration of the drawing assembly 12 and the corresponding compact arrangement of the yarn takeup assembly 14 of the spin-drawing system 10 resides in the ease, convenience and simplicity with which one operator can string up the spin-drawing system 10 and continuously doff yarn packages produced thereby from the yarn winders 68 and 70 as they are filled.

Changes may be made in the combination and arrangement of parts or elements as heretofore set forth in the specification and shown in the drawing without departing from the spirit and scope of the invention as defined and limited only by the following claims.

I claim:

1. Apparatus useable for handling yarns, comprising:

a generally vertical support plate defining a generally vertical support plane;

first and second rolls rotatably mounted on said support plate, said first and second rolls having corresponding first and second axes of rotation lying in corresponding first and second generally horizontal planes vertically spaced one from the other, the first and second axes of rotation defining corresponding first and second acute angles with said generally vertical support plane with said first and second acute angles being substantially equal;

third and fourth rolls rotatably mounted on said support plate, said third and fourth rolls having corresponding third and fourth axes of rotation lying in corresponding third and fourth generally horizontal planes vertically spaced one from the other, the third and fourth axes of rotation defining corresponding third and fourth acute angles with said generally vertical support plane with said third and fourth acute angles being substantially equal to each other and being substantially equal to said first and second acute angles;

said first and third rolls being positioned relative to each other such that a line mutually perpendicular to said first and third axes of rotation and intersecting said first axis of rotation adjacent the outer end thereof remote from said support plate intersects said third axis of rotation adjacent the inner end thereof proximate said support plate;

fifth and sixth rolls rotatably mounted on said support plate, said fifth and sixth rolls having corresponding fifth and sixth axes of rotation lying in corresponding generally vertical planes horizontally spaced one from the other, the fifth axis of rotation being substantially perpendicular to said generally vertical support plane and the sixth axis of rotation intersecting the generally vertical support plane at an angle slightly less than 90°;

said third and fifth rolls being positioned relative to each other such that a line tangent to the cylindrical outer surface of said third roll adjacent the outer end thereof remote from said support plate is mutually tangent to the cylindrical outer surface of said fifth roll adjacent the inner end thereof proximate said support plate;

first drive means operatively related to said first and second rolls for rotating said first and second rolls about their corresponding first and second axes of rotation at rotational speeds producing the same first peripheral speed at the outer surfaces of said first and second rolls;

second drive means operatively related to said third and fourth rolls for rotating said third and fourth rolls about their corresponding third and fourth axes of rotation at rotational speeds producing the same second peripheral speed at the outer surfaces of said third and fourth rolls; and third drive means operatively related to said fifth and sixth rolls for rotating said fifth and sixth rolls about their corresponding fifth and sixth axes of rotation at rotational speeds producing the same third peripheral speed at the outer surfaces of said fifth and sixth rolls; and wherein said third peripheral speed is less than said second peripheral speed and said second peripheral speed is greater than said first peripheral speed.

2. Apparatus in accordance with claim 1 wherein the inner ends of said first, second, third and fourth rolls lie generally in the same plane parallel to said generally vertical support plane.

3. Apparatus in accordance with claim 1 wherein said first, second, third and fourth acute angles lie in the range from about 35° to about 63°.

4. Apparatus in accordance with claim 1 wherein the inner ends of said fifth and sixth rolls lie generally in a common plane parallel to said generally vertical support plane, and wherein the inner ends of said first, second, third and fourth rolls lie generally in a common plane mutually parallel to and between said generally vertical support plane and the plane in which the inner ends of said fifth and sixth rolls generally lie.

5. Apparatus in accordance with claim 4 wherein said first, second, third and fourth acute angles lie in the range from about 35° to about 63°.

6. Apparatus in accordance with claim 1 wherein said first and second axes of rotation generally lie in a common second vertical plane, and said third and fourth axes of rotation generally lie in a common third vertical plane substantially parallel to and horizontally spaced from said second vertical plane.

7. Apparatus in accordance with claim 6 wherein the inner ends of said fifth and sixth rolls generally lie in a common plane parallel to said generally vertical support plane, and wherein the inner ends of said first, second, third and fourth rolls generally lie in a common plane mutually parallel to and between said generally vertical support plane and the plane in which the inner ends of said fifth and sixth rolls generally lie.

8. Apparatus in accordance with claim 7 wherein said first, second, third and fourth acute angles lie in the range from about 35° to about 63°.

9. Apparatus in accordance with claim 1 characterized further to include yarn winder means positioned below said sixth roll for rotating a yarn takeup device located vertically below the outer end portion of said sixth roll.

10. Apparatus in accordance with claim 9 characterized further to include yarn entangler means positioned intermediate said sixth roll and said yarn winder means for entangling yarn filaments passing from the outer end portion of said sixth roll to said yarn winder means.

11. Apparatus in accordance with claim 1 characterized further to include yarn winder means positioned below said fifth roll for rotating a yarn takeup device located vertically below the outer end portion of said fifth roll.

12. Apparatus in accordance with claim 11 characterized further to include yarn entangler means positioned intermediate said fifth roll and said yarn winder means for entangling yarn filaments passing from the outer end portion of said fifth roll to said yarn winder means.

13. Apparatus in accordance with claim 1 characterized further to include:

first yarn winder means positioned below said fifth roll for rotating a yarn takeup device located vertically below the outer end portion of said fifth roll; and second yarn winder means positioned below said sixth roll for rotating a yarn takeup device located vertically below the outer end portion of said sixth roll.

14. Apparatus in accordance with claim 13 characterized further to include:

first yarn entangler means positioned intermediate said fifth roll and said first yarn winder means for entangling yarn filaments passing from the outer end portion of said fifth roll to said first yarn winder means; and second yarn entangler means positioned intermediate said sixth roll and said second yarn winder means for entangling yarn filaments passing from the outer end portion of said sixth roll to said second yarn winder means.

15. Apparatus useable for handling yarns, comprising:

a generally vertical support plate defining a generally vertical support plane;

first and second rolls rotatably mounted on said support plate, said first and second rolls having corresponding first and second axes of rotation lying in corresponding first and second generally horizontal planes vertically spaced one from the other, the first and second axes of rotation defining corresponding first and second acute angles with said generally vertical support plate with said first and second acute angles being substantially equal;

third and fourth rolls rotatably mounted on said support plate, said third and fourth rolls having corresponding third and fourth axes of rotation lying in corresponding third and fourth generally horizontal planes vertically spaced one from the other, the third and fourth axes of rotation defining corresponding third and fourth acute angles with said generally vertical support plane with said third and fourth acute angles being substantially equal to each other and being substantially equal to said first and second acute angles;

said first and third rolls being positioned relative to each other such that a line mutually perpendicular to said first and third axes of rotation and intersecting said first axis of rotation adjacent the outer end thereof remote from said support plate intersects said third axis of rotation adjacent the inner end thereof proximate said support plate;

fifth and sixth rolls rotatably mounted on said support plate, said fifth and sixth rolls having corresponding fifth and sixth axes of rotation lying in corresponding generally vertical planes horizontally spaced one from the other, the fifth axis of rotation being substantially perpendicular to said generally vertical support plane and the sixth axis of rotation intersecting the generally vertical support plane at an angle slightly less than 90°;

said third and fifth rolls being positioned relative to each other such that a line tangent to the cylindrical outer surface of said third roll adjacent the outer end thereof remote from said support plate is mutually tangent to the cylindrical outer surface of said fifth roll adjacent the inner end thereof proximate said support plate;

first drive means operatively related to said first and second rolls for rotating said first and second rolls about their corresponding first and second axes of rotation at rotational speeds producing the same first peripheral speed at the outer surfaces of said first and second rolls;

second drive means operatively related to said third and fourth rolls for rotating said third and fourth rolls about their corresponding third and fourth axes of rotation at rotational speeds producing the same second peripheral speed at the outer surfaces of said third and fourth rolls; and third drive means operatively related to said fifth and sixth rolls for rotating said fifth and sixth rolls about their corresponding fifth and sixth axes of rotation at rotational speeds producing the same third peripheral speed at the outer surfaces of said fifth and sixth rolls; and wherein said third peripheral speed is greater than said second peripheral speed and said second peripheral speed is greater than said first peripheral speed.

16. Apparatus in accordance with claim 15 wherein said first, second, third and fourth acute angles lie in the range from about 35° to about 63°.

17. Apparatus in accordance with claim 15 wherein the inner ends of said fifth and sixth rolls lie generally in a common plane parallel to said generally vertical support plane, and wherein the inner ends of said first, second, third and fourth rolls lie generally in a common plane mutually parallel to and between said generally vertical support plane and the plane in which the inner ends of said fifth and sixth rolls generally lie.

18. Apparatus in accordance with claim 15 wherein said first and second axes of rotation generally lie in a common second vertical plane, and said third and fourth axes of rotation generally lie in a common third vertical plane substantially parallel to and horizontally spaced from said second vertical plane.

19. Apparatus in accordance with claim 18 wherein the inner ends of said fifth and sixth rolls generally lie in a common plane parallel to said generally vertical support plane, and wherein the inner ends of said first, second, third and fourth rolls generally lie in a common plane mutually parallel to and between said generally vertical support plane and the plane in which the inner ends of said fifth and sixth rolls generally lie.

20. Apparatus in accordance with claim 19 wherein said first, second, third and fourth acute angles lie in the range from about 35° to about 63°.

21. Apparatus in accordance with claim 15 characterized further to include yarn winder means positioned below said sixth roll for rotating a yarn takeup device located vertically below the outer end portion of said sixth roll.

22. Apparatus in accordance with claim 21 characterized further to include yarn entangler means positioned intermediate said sixth roll and said yarn winder means for entangling yarn filaments passing from the outer end portion of said sixth roll to said yarn winder means.

23. Apparatus in accordance with claim 15 characterized further to include yarn winder means positioned below said fifth roll for rotating a yarn takeup device located vertically below the outer end portion of said fifth roll.

24. Apparatus in accordance with claim 23 characterized further to include yarn entangler means positioned intermediate said fifth roll and said yarn winder means for entangling yarn filaments passing from the outer end portion of said fifth roll to said yarn winder means.

25. Apparatus in accordance with claim 15 characterized further to include:

first yarn winder means positioned below said fifth roll for rotating a yarn takeup device located vertically below the outer end portion of said fifth roll; and second yarn winder means positioned below said sixth roll for rotating a yarn takeup device located vertically below the outer end portion of said sixth roll.

26. Apparatus in accordance with claim 25 characterized further to include:

first yarn entangler means positioned intermediate said fifth roll and said first yarn winder means for entangling yarn filaments passing from the outer end portion of said fifth roll to said first yarn winder means; and second yarn entangler means positioned intermediate said sixth roll and said second yarn winder means for entangling yarn filaments passing from the outer end portion of said sixth roll to said second yarn winder means.

* * * * *